US010269474B2

(12) United States Patent
Yun et al.

(10) Patent No.: US 10,269,474 B2
(45) Date of Patent: Apr. 23, 2019

(54) CHIP RESISTOR

(71) Applicant: SAMSUNG ELECTRO-MECHANICS CO., LTD., Suwon-si, Gyeonggi-do (KR)

(72) Inventors: Jang Seok Yun, Suwon-si (KR); Kwang Hyun Park, Suwon-si (KR); Kyung Seon Baek, Suwon-si (KR)

(73) Assignee: Samsung Electro-Mechanics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/650,290

(22) Filed: Jul. 14, 2017

(65) Prior Publication Data

US 2018/0130578 A1 May 10, 2018

(30) Foreign Application Priority Data

Nov. 4, 2016 (KR) ..... 10-2016-0146575

(51) Int. Cl.

| | |
|---|---|
| ***H01C 1/01*** | (2006.01) |
| ***H01C 17/00*** | (2006.01) |
| ***H01C 1/028*** | (2006.01) |
| ***H01C 1/14*** | (2006.01) |
| ***H01C 17/22*** | (2006.01) |

(52) U.S. Cl.

CPC ..... *H01C 17/006* (2013.01); *H01C 1/01* (2013.01); *H01C 1/028* (2013.01); *H01C 1/14* (2013.01); *H01C 17/22* (2013.01); *Y10T 29/49082* (2015.01)

(58) Field of Classification Search

CPC ..... H01C 17/006; H01C 17/22; H01C 1/01; H01C 1/028; H01C 1/14

USPC ..... 338/22 R, 13

See application file for complete search history.

(56) References Cited

U.S. PATENT DOCUMENTS

| | | | | |
|---|---|---|---|---|
| 6,097,276 A * | 8/2000 | Van Den Broek | ..... | H01C 7/06 338/22 R |
| 6,943,662 B2 * | 9/2005 | Tanimura | ..... | H01C 1/142 257/537 |
| 2004/0061096 A1 * | 4/2004 | Urano | ..... | H01B 1/22 252/500 |

(Continued)

FOREIGN PATENT DOCUMENTS

| | | |
|---|---|---|
| JP | 2001-143901 A | 5/2001 |
| JP | 2001-155902 A | 6/2001 |

(Continued)

OTHER PUBLICATIONS

Korean Office Action issued in corresponding Korean Patent Application No. 10-2016-0146575, dated Apr. 18, 2018, with English Translation.

(Continued)

*Primary Examiner* — Kyung S Lee

(74) *Attorney, Agent, or Firm* — Morgan Lewis & Bockius LLP

(57) ABSTRACT

A chip resistor includes a board, first and second electrodes disposed on one surface of the board, and a resistor body electrically connecting the first and second electrodes to each other and including a copper-manganese-tin (Cu—Mn—Sn) alloy. In the Cu—Mn—Sn alloy, a percentage of Mn ranges from 11% to 20%, a percentage of Sn ranges from 2% to 8%, and a total percentage of Mn and Sn ranges from 13.5% to 22.5%.

15 Claims, 4 Drawing Sheets

(56) References Cited

U.S. PATENT DOCUMENTS

| | | | | |
|---|---|---|---|---|
| 2009/0002124 | A1 | 1/2009 | Tsai | |
| 2010/0176913 | A1* | 7/2010 | Hirano | H01C 17/006 338/328 |
| 2011/0089025 | A1* | 4/2011 | Yang | C23C 14/185 204/192.21 |
| 2013/0154790 | A1* | 6/2013 | Park | H01C 17/06526 338/309 |
| 2018/0122539 | A1 | 5/2018 | Park et al. | |

FOREIGN PATENT DOCUMENTS

| | | | |
|---|---|---|---|
| JP | 2004-015042 | A | 1/2004 |
| JP | 2004-119692 | A | 4/2004 |
| JP | 2005-353620 | A | 12/2005 |
| JP | 2006-270078 | A | 10/2006 |
| JP | 2009-016793 | A | 1/2009 |
| JP | 2016-069724 | A | 5/2016 |
| JP | 2018-074143 | A | 5/2018 |

OTHER PUBLICATIONS

Japanese Office Action issued in corresponding Japanese Patent Application No. 2017-133420, dated May 29, 2018, with English Translation.

* cited by examiner

CHIP RESISTOR

CROSS-REFERENCE TO RELATED APPLICATION

This application claims benefit of priority to Korean Patent Application No. 10-2016-0146575, filed on Nov. 4, 2016 in the Korean Intellectual Property Office, the disclosure of which is incorporated herein by reference in its entirety.

TECHNICAL FIELD

The present disclosure relates to a chip resistor.

BACKGROUND

In line with an increase in demand for more compact and lightweight electronic devices, chip-type resistors have been widely used to increase the wiring density of circuit boards.

As the required power of electronic devices has increased and the demand for chip resistors detecting an overcurrent within a circuit, and chip resistors detecting remaining battery capacity has increased, chip resistors with high precision, while having low resistance value, have been required. Generally, however, chip resistors have the characteristic that, as the precision thereof is lowered, the resistance value is also lowered. Low precision of resistance value in a chip resistor means a high failure rate in the mass-production of finished products.

SUMMARY

An aspect of the present disclosure may provide a chip resistor having a small absolute value of thermo-electromotive force and a small absolute value of temperature coefficient of resistivity to reduce a failure rate in mass-production of products although the chip resistor is designed with a small resistance value.

According to an aspect of the present disclosure, a chip resistor may include: a board; first and second electrodes disposed on one surface of the board; and a resistor body electrically connecting the first and second electrodes to each other and including a copper-manganese-tin (Cu—Mn—Sn) alloy. In the Cu—Mn—Sn alloy, a weight percentage of Mn ranges from 11% to 20%, a weight percentage of Sn ranges from 2% to 8%, and a total weight percentage of Mn and Sn ranges from 13.5% to 22.5%.

According to another aspect of the present disclosure, a chip resistor may include: a board; first and second electrodes disposed on one surface of the board; and a resistor body electrically connecting the first and second electrodes to each other and including a copper-manganese-tin (Cu—Mn—Sn) alloy. An absolute value of thermo-electromotive force (EMF) of the resistor body is 3 μV/° C. or less and an absolute value of temperature coefficient of resistivity (TCR) of the resistor is 100 ppm/° C. or less.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Exemplary embodiments of the present disclosure will now be described in detail with reference to the accompanying drawings.

Figure 1:
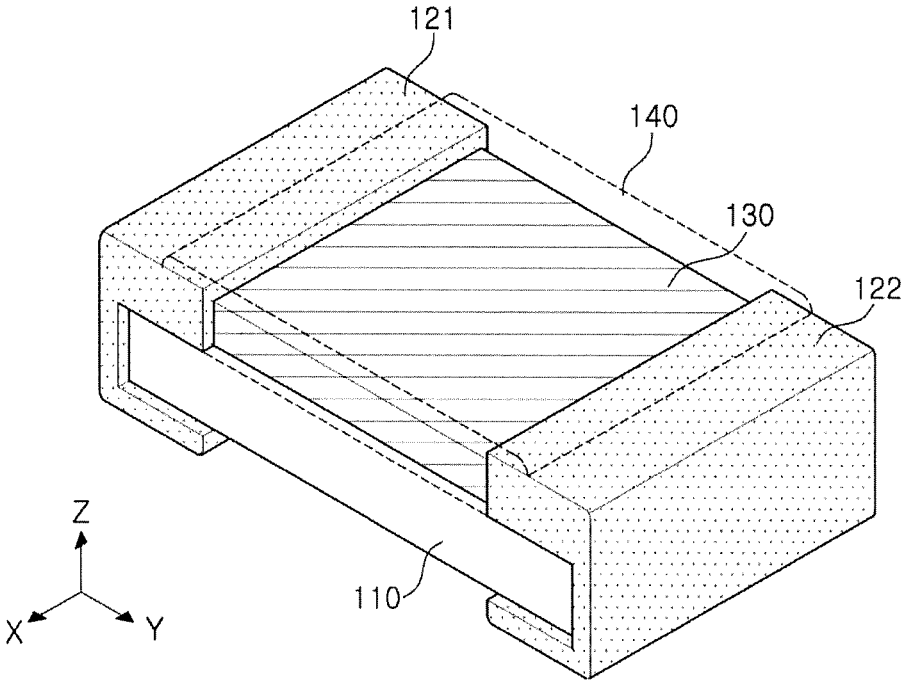
FIG. 1 is a perspective view of a chip resistor according to an exemplary embodiment in the present disclosure.

FIG. 1 is a perspective view of a chip resistor according to an exemplary embodiment in the present disclosure.

Figure 2:
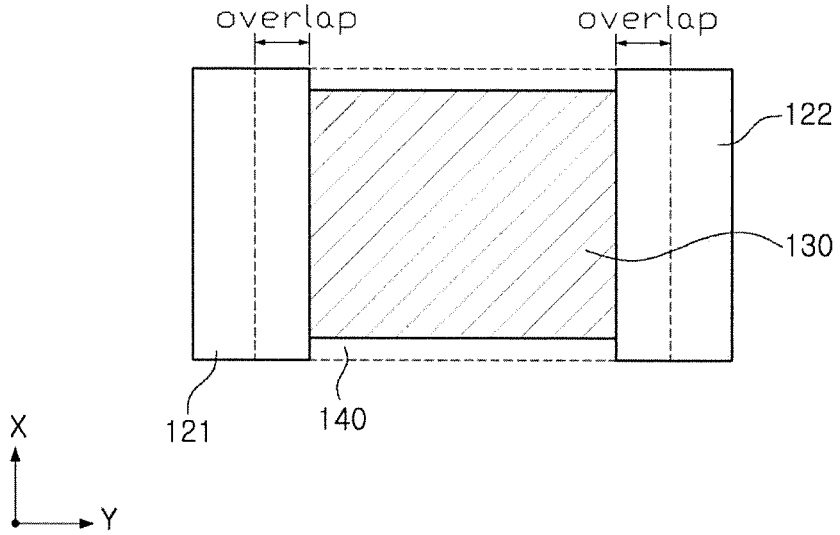
FIG. 2 is a rear view of a chip resistor according to an exemplary embodiment in the present disclosure.

FIG. 2 is a rear view of a chip resistor according to an exemplary embodiment in the present disclosure.

Referring to FIGS. 1 and 2, a chip resistor according to an exemplary embodiment in the present disclosure may include a board 110, a first electrode 121, a second electrode 122, and a resistor body 130, and may further include a protective layer 140.

The board 110 may provide support for mounting an electrode and a resistor body. For example, the board 110 may be an insulating board formed of a ceramic material. The ceramic material may be alumina ($Al_2O_3$) and not be limited as long as it has excellent insulating properties, heat resistance, and adhesion.

The first electrode 121 may be disposed on one surface of the board 110.

The second electrode 122 may be disposed to be spaced apart from the first electrode 121 on the one surface of the board 110.

For example, the first and second electrodes 121 and 122 may have a low resistance value using copper or a copper alloy. For example, the first and second electrodes 121 and 122 may be formed on the board 110 through a screen method such as painting, spouting, or printing paste in an ink state, or the like, on the board 110.

The resistor body 130 may electrically connect the first electrode 121 and the second electrode 122 and have portions (labeled "overlap" in FIG. 2) overlapping the first electrode 121 and the second electrode 122, and may include a copper-manganese-tin (Cu—Mn—Sn) alloy.

A resistance value of the resistor body 130 may be lowered as a weight percentage of copper (Cu) of the Cu—Mn—Sn alloy is increased.

A resistance value of the resistor body 130 may be finely adjusted through a trimming operation on the resistor body 130. Here, the trimming operation refers to an operation of simultaneously measuring a resistance value of the resistor body, while forming a groove on the resistor body, and stopping formation of the groove when the resistance value approximates to a target resistance value to thus adjust the resistance value of the resistor body. In this manner, the chip resistor according to an exemplary embodiment may have high precision, while having a small resistance value of 100 mΩ or less.

However, in the trimming operation, heat may generally be emitted, while forming the groove. Heat generated by the trimming operation may cause distortion during a process of measuring a resistance value regarding the resistor body 130 and generate electromotive force (EMF) in accordance with a distribution of heat. The EMF may cause more significant distortion during a process of measuring a resistance value regarding the resistor 130. Such distortion may cause a defect during a process of mass-producing a chip resistor.

Thus, the resistor body 130 is required to have good temperature characteristics and good temperature distribution characteristics to have high precision, while having a small resistance value.

A resistance value of the resistor body 130 may be varied depending on temperature of the resistor body 130. Temperature characteristics of the resistor body 130 may be expressed as a temperature coefficient of resistivity (TCR), a variation rate of a resistance value in accordance with a change in temperature. The TCR of the resistor body 130 may be lowered as a weight percentage of manganese (Mn) and/or tin (Sn) to the Cu—Mn—Sn alloy. As an absolute value of the TCR is smaller, the resistor 130 may be more resistant to changes in temperature.

A resistance value of the resistor body 130 may be varied in accordance with a temperature distribution of the resistor body 130. In cases where a temperature of the first electrode 121 adjacent to one end of the resistor body 130 and a temperature of the second electrode 122 adjacent to the other end of the resistor body 130 are different, EMF may be generated in the resistor body 130. Temperature distribution characteristics of the resistor body 130 may be expressed as a thermo-electromotive force (EMF) in accordance with a temperature difference. Thermo-EMF of the resistor body 130 may be increased as a weight percentage of manganese (Mn) to the Cu—Mn—Sn alloy is increased, and may be lowered as a weight percentage of tin (Sn) is increased. As an absolute value of the thermo-EMF is smaller, the resistor body 130 may be more robust to heat in accordance with the trimming operation.

A failure rate in accordance with the trimming operation in mass-production of the chip resistor may be significantly reduced when an absolute value of thermo-EMF is 3 μV/° C. or less and may be significantly reduced when an absolute value of the TCR of the resistor body 130 is 100 ppm/° C. or less. Thus, the Cu—Mn—Sn alloy included in the resistor body 130 may have weight percentages such that the absolute value of the thermo-EMF of the resistor 130 is 3 μV/° C. or less and the absolute value of the TCR is 100 ppm/° C. or less.

Resistance (Rs), and TCR, and thermo-EMF per unit area in accordance with a weight percentage of Cu—Mn—Sn are illustrated in Table 1 below.

TABLE 1

| | Composition | | | | Characteristics | | |
|---|---|---|---|---|---|---|---|
| No. | Cu | Mn | Sn | Mn + Sn | Rs | TCR | Thermo-EMF |
| 1 | 90.5 | 7 | 2.5 | 9.5 | 26 | 255 | −0.18 |
| 2 | 86.5 | 11 | 2.5 | 13.5 | 41 | 104 | +0.58 |
| 3 | 83.5 | 14 | 2.5 | 16.5 | 55 | −65 | +1.25 |
| 4 | 80.5 | 17 | 2.5 | 19.5 | 74 | −81 | +2.16 |
| 5 | 77.5 | 20 | 2.5 | 22.5 | 98 | −102 | +2.78 |
| 6 | 84 | 14 | 2 | 16 | 51 | −56 | +1.39 |

TABLE 1-continued

| | Composition | | | | Characteristics | | |
|---|---|---|---|---|---|---|---|
| No. | Cu | Mn | Sn | Mn + Sn | Rs | TCR | Thermo-EMF |
| 7 | 82 | 14 | 4 | 18 | 69 | −66 | +0.98 |
| 8 | 80 | 14 | 6 | 20 | 88 | −75 | +0.86 |
| 9 | 78 | 14 | 8 | 22 | 107 | −91 | +0.57 |

Here, a unit of resistance (Rs) per unit area is mΩ, a unit of TCR is ppm/° C., and a unit of thermo-EMF is μV/° C.

Referring to Table 1, the TCR and the thermo-EMF may be substantially 100 ppm/° C. or lower and 3 μV/° C. or lower when a weight percentage of tin (Sn) is 2.5% and a weight percentage of manganese (Mn) ranges from 11% to 20%. Also, the TCR may be lowered as the weight percentage of Mn is increased, and the thermo-EMF may be increased as the weight percentage of Mn is increased.

Referring to Table 1, the TCR and the thermo-EMF may be substantially 100 ppm/° C. or lower and 3 μV/° C. or lower when a weight percentage of tin (Sn) ranges from 2% to 8% and a weight percentage of manganese (Mn) is 14%. Also, the TCR may be lowered as the weight percentage of Sn is increased, and the thermo-EMF may be increased as the weight percentage of Sn is increased.

In order for the resistor body 130 to have an absolute value of a small TCR, a weight percentage of Mn—Sn is required to be within a predetermined range. Also, in order for the resistor body 130 to have an absolute value of small thermo-EMF and a small resistance value, a weight percentage of Mn and a weight percentage of Sn are required to be within a predetermined range. Here, the small resistance value may be substantially 100 mΩ or less.

Referring to Table 1, in the Cu—Mn—Sn alloy included in the resistor body 130, a weight percentage of Mn—Sn may be designed to range from 13.5% to 22.5%, a weight percentage of Mn may be designed to range 11% to 20%, and a weight percentage of Sn may be designed to range from 2% to 8%.

Accordingly, the resistor body 130 may have a small absolute value of TCR and a small absolute value of thermo-EMF, and although the resistor body 130 is designed to have a small resistance value, a failure rate in mass-production of products may be reduced.

The resistor body 130 may be bonded to the board 110 by paste during a process. The paste may include a resin such as ethylcellulose (EC), acryl, and the like, and a solvent. In the Cu—Mn—Sn alloy, resin, and solvent before the process of the resistor body 130, a weight percent (w %) of the resin may range from 1% to 5% and a weight percent of the solvent may range from 5% to 20%. The resin and the solvent may be removed during the process of the resistor body 130.

The resistor 130 may further include glass to have enhanced adhesion, while not significantly affecting the thermo-EMF and the TCR.

Also, the resistor body 130 may have a form of paste sintered under a reduction atmosphere. That is, the resistor body 130, when sintered, may be alloyed by ionic diffused bonding so as to be bonded to the board 110. Here, recrystallization may be made between the resistor body 130 and the first electrode 121 and the second electrode 122 and grain growth may take place. Here, electrical conductivity between the resistor 130 and the first electrode 121 or the second electrode 122 may be enhanced. Accordingly, the chip resistor according to an exemplary embodiment may be realized to have a resistance value of 100 mΩ or lower.

The protective layer 140 may cover at least a portion of one surface of the resistor body 130. The protective layer 140 may prevent deformation of the resistor body 130 caused by the trimming operation. For example, the protective layer 140 may include at least one of epoxy, a polymer such as phenol resin, or the like, and glass.

Figure 3:
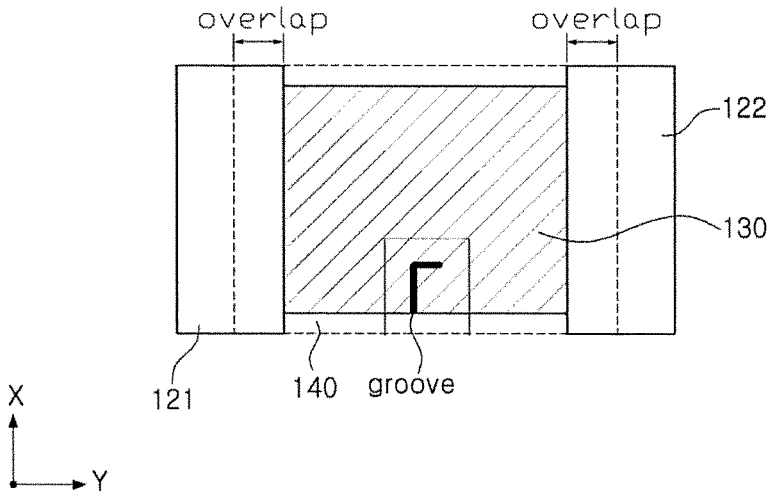
FIG. 3 is a view illustrating a groove formed in a resistor body of a chip resistor according to an exemplary embodiment in the present disclosure.

FIG. 3 is a view illustrating a groove formed in a resistor body of a chip resistor according to an exemplary embodiment in the present disclosure.

Referring to FIG. 3, the resistor body 130 may have a groove formed through the trimming operation. For example, the groove may be formed from an edge of the resistor body 130 toward a center thereof. Thereafter, when a resistance value of the resistor 130 approximates to a target resistance value, the groove may be formed from the center of the resistor body 130 toward the first electrode 121 or the second electrode 122. Accordingly, the groove may have an L shape. Alternatively, the groove may have a 11 shape or an i shape depending on a shape of the resistor body 130.

Figure 4:
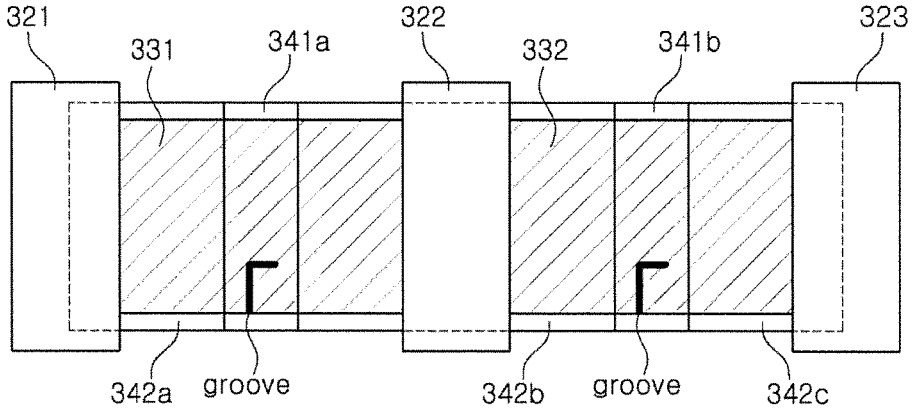
FIG. 4 is a view illustrating a three-electrode form of a chip resistor according to an exemplary embodiment in the present disclosure.

FIG. 4 is a view illustrating a three-electrode form of a chip resistor according to an exemplary embodiment in the present disclosure.

Referring to FIG. 4, a chip resistor according to an exemplary embodiment may include, a board, a first electrode 321, a second electrode 322, a third electrode 323, a first resistor body 331, a second resistor body 332, first protective layers 341*a* and 341*b* and second protective layers 342*a*, 342*b*, and 342*c*. Here, the board, the first electrode 321, the second electrode 322, the first and second resistor bodies 331, 332, the first protective layers 341*a* and 341*b*, and the second protective layers 342*a*, 342*b*, and 342*c* may be substantially the same as the board, the first electrode, the second electrode, the resistor body, and the protective layer described above.

The third electrode 323 may be electrically connected to the first electrode 321 from an outside to serve as a reserve electrode with respect to the first electrode 321. Here, the first resistor body 331 and the second resistor body 332 may be connected in parallel. If the first electrode 321 is disconnected from the outside due to a defect that occurs during a manufacturing process or an impact that may occur during a use process, the third electrode 323 may play the role of the first electrode 321.

Meanwhile, the first protective layers 341*a* and 341*b* may cover the grooves of first and second resistor bodies 331, 332, and the second protective layers 342*a*, 342*b*, and 342*c* may cover regions not covered by the first protective layers 341*a* and 341*b* in the first and second resistor bodies 331 and 332. The first protective layers 341*a* and 341*b* and the second protective layers 342*a*, 342*b*, and 342*c* may be formed of different materials to have different heat dissipation characteristics.

Figure 5:
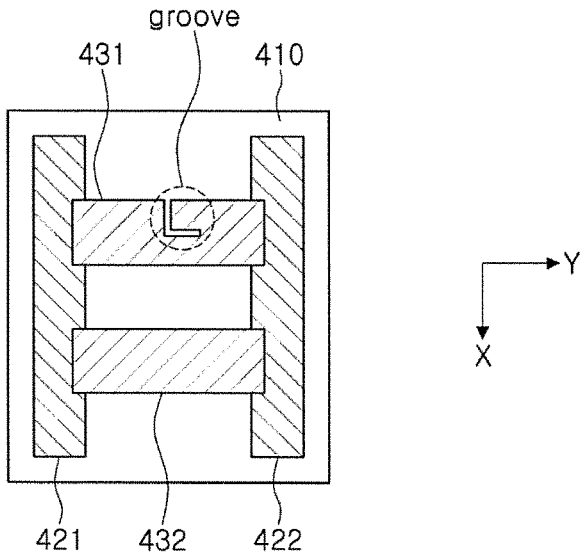
FIG. 5 is a view illustrating parallel connection of resistor bodies of a chip resistor according to an exemplary embodiment in the present disclosure.

FIG. 5 is a view illustrating parallel connection of resistor bodies of a chip resistor according to an exemplary embodiment in the present disclosure.

Referring to FIG. 5, a chip resistor according to an exemplary embodiment may include aboard 410, a first electrode 421, a second electrode 422, a first resistor body 431, and a second resistor body 432. Here, the board 410, the first electrode 421, the second electrode 422, the first resistor 431, and the second resistor 432 may be substantially the same as the board, the first electrode, the second electrode, and the resistor body described above.

The first resistor 431 and the second resistor 432 may be connected in parallel. For example, the first resistor 431 and the second resistor 432 may include Cu—Mn—Sn alloys having different weight percentages.

For example, a weight percentage of manganese (Mn) to the Cu—Mn—Sn alloy included in the second resistor body 432 may be greater than a weight percentage of Mn to the Cu—Mn—Sn alloy included in the first resistor body 431, and a weight percentage of tin (Sn) to the Cu—Mn—Sn alloy included in the second resistor body 432 may be less than a weight percentage of Sn to the Cu—Mn—Sn alloy included in the first resistor body 431.

Accordingly, a thermo-EMF, a TCR, and a resistance value of the chip resistor according to an exemplary embodiment may be more minutely adjusted.

Figure 6:
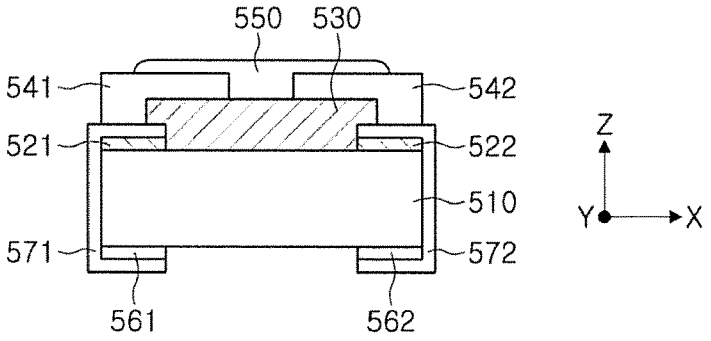
FIG. 6 is a side view of a chip resistor according to an exemplary embodiment in the present disclosure.

FIG. 6 is a side view of a chip resistor according to an exemplary embodiment in the present disclosure.

Referring to FIG. 6, the chip resistor according to an exemplary embodiment may include a board 510, a first electrode 521, a second electrode 522, a resistor body 530, a first upper electrode 541, a second upper electrode 542, a protective layer 550, a first lower electrode 561, a second lower electrode 562, a first metal cover 571, and a second metal cover 572.

The first and second upper electrodes 541 and 542 may be disposed on a surface of at least one of the first electrode 521, the second electrode 522, and the resistor body 530. When the first and second upper electrodes 521 and 542 are disposed on the first and second electrodes 521 and 522, respectively, the first and second upper electrodes 541 and 542 may serve as lines for receiving a current from the outside or providing a current to the outside. When the first and second upper electrodes 541 and 542 are disposed on the resistor body 530, the first and second upper electrodes 541 and 542 may effectively dissipate heat generated by the resistor body 530 using high thermal conductivity, characteristics of a metal. The protective layer 550 may cover an upper surface of at least one of the first electrode 521, the second electrode 522, the resistor body 530, the first upper electrode 541, and the second upper electrode 542. For example, the protective layer 550 may be formed of an epoxy, a phenol resin, glass, and the like, to protect the chip resistor from an external physical impact.

The first and second lower electrodes 561 and 562 may assist disposition of the first and second electrodes 521 and 522. For example, the first and second metal covers 571 and 572 having a U shape may be inserted into opposing side surfaces of the board 510. The first and second metal covers 571 and 572 may press and fixate the first and second electrodes 521 and 522. Here, the first and second lower electrodes 561 and 562 may be formed on the other surfaces of the substrate 510 in advance and pressed by the first and second metal covers 571 and 572. Accordingly, the first and second electrodes 521 and 522 may be stably fixated. Also, as a total area of the first and second lower electrodes 561 and 562 and the first and second electrodes 521 and 522 is increased, a resistance value of the first and second electrodes 521 and 522 may be further reduced. Accordingly, a total resistance value of the chip resistor according to an exemplary embodiment may be further reduced.

Figure 7:
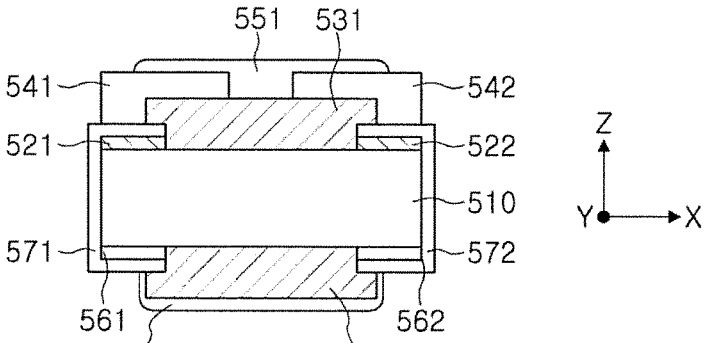
FIG. 7 is a side view illustrating double-sided disposition of resistor bodies of a chip resistor according to an exemplary embodiment in the present disclosure.

FIG. 7 is a side view illustrating double-sided disposition of resistor bodies of a chip resistor according to an exemplary embodiment in the present disclosure.

Referring to FIG. 7, the chip resistor according to an exemplary embodiment may include a board 510, a first electrode 521, a second electrode 522, a first resistor body 531, a second resistor body 532, a first upper electrode 541, a second upper electrode 542, a first protective layer 551, a second protective layer 552, a first lower electrode 561, a second lower electrode 562, a first metal cover 571, and a second metal cover 572.

The first resistor body 531 may be disposed on one surface of the board 510 and directly connected to the first and second electrodes 521 and 522. The first protective layer 551 may be formed on one surface of the first resistor 531.

The second resistor 532 may be disposed on the other surface of the board 510 and directly connected to the first and second lower electrodes 561 and 562. The first protective layer 552 may be formed on one surface of the second resistor 532.

The first electrode 521 and the first lower electrode 561 may be electrically connected through the first metal cover 571, and the second electrode 522 and the second lower electrode 562 may be electrically connected through the second metal cover 572. Accordingly, the first resistor 531 disposed on one surface of the board 510 and the second resistor 532 disposed on the other surface of the board 510 may be in a parallel relationship.

Since the first resistor 531 and the second resistor 532 are disposed on the opposing surfaces of the board 510, a width of the board 510 may be reduced. Also, when the first and second resistor bodies 531 and 532 including different components are formed, an influence made on each other may be reduced.

Figure 8:
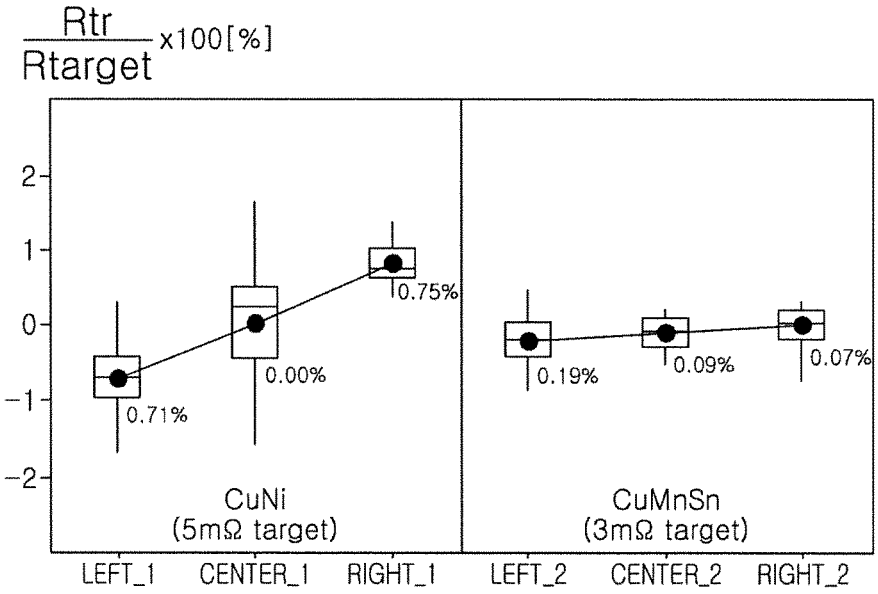
FIG. 8 is a graph illustrating a change in resistance value in accordance with a position of a groove formed in a resistor body.

FIG. 8 is a graph illustrating a change in resistance value in accordance with a position of a groove formed in a resistor body.

Referring to FIG. 8, the vertical axis represents a percentage ($R_{tr}/R_{target}$*100) having a relative magnitude with respect to a target resistance value ($R_{target}$) of a resistance value ($R_{tr}$) after formation of a groove of a resistor body. LEFT_1 represents a case in which a groove is positioned on the left in a resistor body including Cu—Ni according to comparative example of the present disclosure. CENTER_1 represents a case in which a groove is positioned at the center in the resistor body including Cu—Ni according to comparative example of the present disclosure. RIGHT_1 represents a case in which a groove is positioned on the right in the resistor body including Cu—Ni according to comparative example of the present disclosure. LEFT_2 represents a case in which a groove is positioned on the left in the resistor body of an exemplary embodiment in the present disclosure. CENTER_2 represents a case in which a groove is positioned at the center in the resistor body of an exemplary embodiment in the present disclosure. RIGHT_2 represents a case in which a groove is positioned on the right in the resistor body of an exemplary embodiment in the present disclosure.

A resistance value of the resistor body including Cu—Ni according to comparative example of the present disclosure may be relatively significantly changed according to a change in a groove formation position. In contrast, since the chip resistor according to an exemplary embodiment in the present disclosure has a small thermal-EMF absolute value and small TCR absolute value, the chip resistor according to an exemplary embodiment may have a resistance value robust to a change in a groove formation position. Thus, although the chip resistor according to an exemplary embodiment is designed to have a small resistance value, a failure rate in mass-production may be reduced.

As set forth above, although the chip resistor according to exemplary embodiments of the present disclosure is designed to have a small resistance value, it may have a small thermo-EMF absolute value and a small TCR absolute value to reduce a failure rate in mass-production.

While exemplary embodiments have been shown and described above, it will be apparent to those skilled in the art that modifications and variations could be made without departing from the scope of the present invention as defined by the appended claims.

What is claimed is:

1. A chip resistor comprising:

a board;

first and second electrodes disposed on one surface of the board; and a first resistor body electrically connecting the first and second electrodes to each other and including a copper-manganese-tin (Cu—Mn—Sn) alloy, wherein, in the Cu—Mn—Sn alloy, a weight percentage of Mn ranges from 11% to 20%, a weight percentage of Sn ranges from 2% to 6%, and a total weight percentage of Mn and Sn ranges from 16.5% to 20%.

2. The chip resistor of claim 1, wherein an absolute value of thermo-electromotive force (EMF) of the first resistor body is 3 μV/° C. or less and an absolute value of temperature coefficient of resistivity (TCR) of the first resistor body is 100 ppm/° C. or less.

3. The chip resistor of claim 1, wherein a resistance value of the first resistor body exceeds 0Ω and is less than or equal to 100 mΩ.

4. The chip resistor of claim 1, wherein the first resist body has a groove.

5. The chip resistor of claim 1, wherein the first resistor body further includes glass.

6. The chip resistor of claim 1, further comprising a second resistor body electrically connecting the first and second electrodes to each other and including a Cu—Mn—Sn alloy, wherein a weight percentage of Mn in the Cu—Mn—Sn alloy included in the second resistor body is greater than the weight percentage of Mn in the Cu—Mn—Sn alloy included in the first resistor body, and a weight percentage of Sn in the Cu—Mn—Sn alloy included in the second resistor body is less than the weight percentage of Sn in the Cu—Mn—Sn alloy included in the first resistor body.

7. A chip resistor comprising:

a board;

first and second electrodes disposed on one surface of the board; and a resistor body electrically connecting the first and second electrodes to each other and including a copper-manganese-tin (Cu—Mn—Sn) alloy, wherein an absolute value of thermo-electromotive force (EMF) of the resistor body is 3 μV/° C. or less and an absolute value of temperature coefficient of resistivity (TCR) of the resistor is 100 ppm/° C. or less, wherein, in the Cu—Mn—Sn alloy, a weight percentage of Sn ranges from 2% to 6%, and a total weight percentage of Mn and Sn ranges from 16.5% to 20%.

8. The chip resistor of claim 7, wherein a weight percentage of Mn in the Cu—Mn—Sn alloy ranges from 11% to 20%.

9. The chip resistor of claim 7, wherein a weight percentage of Cu in the Cu—Mn—Sn alloy ranges from 77.5% to 86.5%.

10. A chip resistor comprising:

a board;

first and second electrodes disposed on the board; and a first resistor body having a groove, electrically connecting the first and second electrodes to each other and including a copper-manganese-tin (Cu—Mn—Sn) alloy, wherein in the Cu—Mn—Sn alloy, a total weight percentage of Mn and Sn ranges from 16.5% to 20%.

11. The chip resistor of claim 10, wherein in the Cu—Mn—Sn alloy, a weight percentage of Sn ranges from 2% to 6%.

12. The chip resistor of claim 10, wherein the resistor body further includes glass.

13. The chip resistor of claim 10, further comprising a protective layer covering the resistor body.

14. The chip resistor of claim 10, wherein an absolute value of thermo-electromotive force (EMF) of the resistor body is 3 μV/° C. or less and an absolute value of temperature coefficient of resistivity (TCR) of the resistor is 100 ppm/° C. or less.

15. The chip resistor of claim 10, wherein a resistance value of the resistor body is less than or equal to 100 mΩ.

* * * * *